US006026570A

United States Patent [19]

Bohm et al.

[11] Patent Number: 6,026,570

[45] Date of Patent: Feb. 22, 2000

[54] METHOD FOR PRODUCING AN EXHAUST GAS MANIFOLD FOR A MULTI-CYLINDER ENGINE

[75] Inventors: Alfons Bohm, Meitingen; Bernhard Grescher, Fischach; Enrique Santiago, Diedorf, all of Germany

[73] Assignee: Zeuna-Staker GmbH & Co., KG, Augsburg, Germany

[21] Appl. No.: 09/034,156

[22] Filed: Mar. 2, 1998

Related U.S. Application Data

[62] Division of application No. 08/731,211, Oct. 10, 1996, abandoned, which is a continuation of application No. PCT/EP95/01749, May 9, 1995.

[30] Foreign Application Priority Data

May 11, 1994 [DE] Germany ..... 94 07 812 U

[51] Int. Cl.[7] ..... B23D 39/00

[52] U.S. Cl. ..... 29/890.08; 29/890.148

[58] Field of Search ..... 29/890.08, 890.148; 138/177

[56] References Cited

U.S. PATENT DOCUMENTS

| | | | |
|---|---|---|---|
| 1,294,475 | 2/1919 | Kirkham . | |
| 1,431,120 | 10/1922 | Krafve . | |
| 2,833,368 | 5/1958 | Lowther . | |
| 2,881,851 | 4/1959 | Willsea . | |
| 4,779,705 | 10/1988 | Verdin . | |
| 4,800,720 | 1/1989 | Okada . | |
| 4,864,978 | 9/1989 | Fukazawa . | |
| 4,887,557 | 12/1989 | Sukimoto et al. | 123/52 MC |
| 4,959,956 | 10/1990 | Yasuda | 60/323 |
| 4,998,754 | 3/1991 | Matsumoto et al. | 138/177 |
| 5,148,597 | 9/1992 | Weeks | 29/890.08 |
| 5,170,557 | 12/1992 | Rigsby | 29/890.08 |
| 5,471,857 | 12/1995 | Dickerson | 72/57 |
| 5,697,155 | 12/1997 | Bloecker et al. | 29/890.148 |
| 5,829,219 | 11/1998 | Sugawara et al. | 29/890.148 |

FOREIGN PATENT DOCUMENTS

| | | |
|---|---|---|
| 61-086029 | 5/1986 | Japan . |
| 62-206216 | 9/1987 | Japan . |
| 63-260632 | 10/1988 | Japan . |
| 63-273525 | 11/1988 | Japan . |
| 4-148017 | 5/1992 | Japan . |
| 4-187812 | 7/1992 | Japan . |

*Primary Examiner*—Irene Cuda
*Attorney, Agent, or Firm*—Helfgott & Karas, P.C.

[57] ABSTRACT

A tube junction is produced having at least two inlets and an outlet, and at least one bend between the two inlets by providing a forging die with a first recess contoured to hold a bent tube piece. A second recess opens into the first recess and, terminates in a moveable counterpunch. A tube piece having two inlets is bent to bring the two inlets into positions relative to each other generally similar to relative positions of the inlets in a finished tube junction. The bent tube piece is placed within the forging die, and pressurized internally to bulge the tube piece wall into the second recess and form a neck for the outlet. Motion of the counterpunch away from the first recess is controlled as the neck forms under pressure in the second recess.

6 Claims, 2 Drawing Sheets

METHOD FOR PRODUCING AN EXHAUST GAS MANIFOLD FOR A MULTI-CYLINDER ENGINE

This application is a division of application Ser. No. 08/731,211, filed Oct. 10, 1996 now abandoned, which in turn is a continuation of application Ser. No. PCT/EP95/01749, filed on May 9, 1995.

BACKGROUND OF THE INVENTION

The present invention relates to an exhaust gas manifold for a multi-cylinder engine, which passes the exhaust gas of several cylinders to a common outlet, and is made without any weld seam, in that it is formed from a tube piece with at least one neck formed in the side wall of the tube piece.

Such an exhaust gas manifold is disclosed in the Japanese patent application 62-206216. In this known exhaust gas manifold, two necks are formed in the side wall of a straight tube piece; these necks, after having been provided with openings, serve as exhaust gas inlets of the exhaust gas manifold. One of the two open ends serves as the outlet of the exhaust gas manifold.

In this exhaust gas manifold, it has proven to be a disadvantage that it is only suitable for bringing together the exhaust gas of adjacent cylinders. It is unsuitable, for example, for bringing together the exhaust gas of cylinders 1 and 4 of a four-cylinder in-line engine, as is desirable for high-performance engines, to increase their performance; this is because it would not be possible to install a second exhaust gas manifold which brings together the exhaust gas of cylinders 2 and 3.

Furthermore, other tube junctions formed in the most varied ways are also known. For example, the German utility model 9100867 describes a tube junction in which two tube segments which have been flattened on one side at the end and which rest against each other are inserted into a larger tube. In the tube junction known from the European patent application 192995, a main tube has an incision into which the end of another tube segment, which is formed accordingly, opens; the tube segment is connected with the main tube by welding. The German Offenlegungschrift 4228372 describes a tube junction in which a tube segment is inserted, at its end, into a neck which is mechanically produced in a tube elbow. In all three known tube junctions, it is a disadvantage that they are composed of two or three separate parts. This results in significant production costs. One of the reasons these costs are so high is that the parts to be connected with each other must fit precisely relative to one another, and must be aligned correctly with one another, so that sufficient mechanical strength and a leak-proof seal of the tube junction is guaranteed.

In exhaust gas manifolds known from car racing, which are formed as a tube junction, a hole is cut in the outside wall of a pre-bent tube, generally using a laser cutter, and a correspondingly adapted tube is welded into it. Such tube junctions suffer from the same disadvantages as those described above.

Tube junctions produced from two half shells are also expensive to produce, because of the long weld seams which connect the two half shells with each other.

Another tube junction is described in the German patent 4103083. This known tube junction proceeds from a tube piece which has been hydrostatically transformed, especially widened, and subsequently been converted to a double tube in certain regions, by being indented. In this known tube junction it is disadvantageous that the arrangement of the two inlets cannot be freely selected; instead, the two inlets are always very closely adjacent.

In the article "Hydrostatic forming of tubing produces complex parts" (57 Automation 10 (1963.06) p. 85/85), the method of hydrostatic forming is explained in connection with different hollow elements, and the formation of a neck in the wall of a bent tube piece is also presented.

SUMMARY OF THE INVENTION

The present invention is based on the task of creating a light, stable exhaust gas manifold of the type stated initially, which can be easily and inexpensively produced, in which the arrangement of the at least two inlets can be selected in almost any way desired, relative to one another. The background for this statement of task is, in particular, the available space for the installation of exhaust gas manifolds structured as tube junctions in internal combustion engines, since this space is often limited.

In accordance with the present invention, this task is accomplished by means of an exhaust gas manifold for a multi-cylinder engine, which passes the exhaust gas of several cylinders to a common outlet, and is made without any weld seam, in that it is formed from a tube piece with at least one neck formed in the side wall of the tube piece, where the tube piece is bent in such a way that its two ends serve as inlets, where the neck serves as a common outlet. The exhaust gas manifold according to the present invention therefore consists of a single component. It is not necessary to join together several components, in an expensive process, in order to produce the exhaust gas manifold according to the invention. Accordingly, the latter also does not have any kind of weld seams or similar features. It is therefore absolutely sealed; and there is no weakening of the material due to weld seams. The exhaust gas manifold according to the invention can therefore also be produced from a material winch is not well suited or not at all suited for welding. Furthermore, the two inlets formed by the ends of the tube piece can possess almost any desired arrangement relative to one another, by bending the tube piece accordingly. By making it possible to arrange the two inlets in any desired way relative to one another, the invention particularly permits making available an inexpensive, light exhaust gas manifold, in which the exhaust gas of cylinders 1 and 4 of a four-cylinder in-line engine, which are far apart from one another, is brought together. To produce an exhaust gas manifold according to the invention with three or more inlets, it is practical if the inlets over and above the two formed by the ends of the tube piece are formed by necks formed in the side wall of the tube piece.

The exhaust gas system of a four-cylinder engine can comprise two exhaust gas manifolds according to the invention, each of which combines two cylinders with one another—cylinder 1 and 4, i.e. 2 and 3 in the case of a four-cylinder in-line engine. However, a combination of a manifold according to the invention for cylinders 1 and 4 with one for cylinders 2 and 3 having a conventional structure is also possible.

In the sense of the present application, "tube" and "tube segment" are not understood to mean only those with a circular cross-section. Tubes or tube segments with different cross-sections (e.g. rectangular, oval, polygonal) can also be used within the framework of the invention. Furthermore, it is not precluded that the cross-section changes over the length of the tube piece (e.g. widens, narrows, is constricted in places).

To produce the exhaust gas manifold according to the invention, it is practical if the neck which later serves as an outlet is introduced into the tube piece by means of the method of interior high pressure deformation (IHV). It is especially preferred in this connection if the tube piece is bent in such a way, before the neck is formed, that its two ends which later serve as an inlet have essentially their final position relative to one another, and if the progression of the tube piece, between the subsequent inlets and the subsequent outlet, already corresponds to the final progression. For interior high pressure deformation, such a pre-bent tube piece is then placed in a forging die which has a first recess to hold the pre-bent tube piece, as well as a second recess which opens up into this first recess, in its impression. During the process of interior high pressure deformation, the tube piece is deformed into the second recess, in order to form the outlet. It is practical in this connection if the formation of the neck into the second recess of the forging die takes place under the control of a counter-punch. The counter-punch retracts in a defined manner, as the neck is formed in the second recess. In this way, overly rapid formation of the neck, with a correspondingly great decrease in wall thickness, is avoided. Instead, the formation of the neck takes place so slowly, because of the defined counter-force of the counter-punch, that the tube piece can be followed up from one or both ends. For corresponding swaging of the tube piece during interior high pressure deformation, at least one axial punch which can be moved in the first recess is provided, which exerts an axial force on the end of the tube segment assigned to it, so that material flows into the deformation region of the neck.

For the production of additional necks which can serve as additional inlets, a corresponding number of third recesses which open into the first recess can be provided in the forging die.

A device suitable for production of the exhaust gas manifold according to the invention has the following characteristics:

A forging die has an impression with a first recess to hold a tube piece, and a second recess which opens into the first recess;

two axial punches are provided in the first recess, at least one of which has a line bore to fee a pressure medium into the interior of the tube piece placed into the first recess;

a counter-punch which can be moved is located in the second recess.

A significant characteristic of this device is therefore the counter-punch provided in the second recess, which ensures controlled formation of the neck during interior high pressure deformation, in the manner described above and explained in greater detail below. The forging die consists of two or more mold parts, depending on the final shape of the tube junction.

The retraction of the counter-punch as formation of the neck progresses can take place against the force of a spring element. Also, retraction of the counter-punch as a function of time or of the pressure prevailing inside the tube piece, controlled by means of a corresponding device, is also possible.

It is practical if at least one of the two axial punches of the device described is guided so that it can be moved in the first recess during interior high pressure deformation, so that the assigned end of the tube piece can be followed up during interior high pressure deformation, in accordance with the formation of the neck. A follow-up device acts on this movable axial punch. This device can be path-controlled, for example; this means that the axial punch is moved a pre-determined path distance as a fixed function of the pressure prevailing in the tube piece. Furthermore, force control is also possible, in which a defined force swaging the tube piece is applied to the axial punch. Furthermore, a combined path-force control can be provided to move the axial punch. Finally, it is also possible to use the escape path of the counter-punch or the force acting on it as the input value for controlling the movement of the axial punch. Also, the force acting on a punch can be controlled as the function of the displacement path of any (other) punch; this holds true both for one or both axial punches and for the counter-punch or counter-punches in the case of several necks. Control of the movable punch(es) is not, however, compulsory.

In order to make the displacement movement of the counter-punch in the forging die possible, the second recess preferably has a cylindrical segment in which the counter-punch is guided. The same thing holds true for the first recess, if one or both axial punches are supposed to be movable, in order to be able to push in the end of the tube piece assigned to them during the process of interior high pressure deformation.

BRIEF DESCRIPTION OF THE DRAWINGS

In the following, the invention will be explained in greater detail using the drawings. These show.

DESCRIPTION OF A PREFERRED EMBODIMENT

Figure 1:
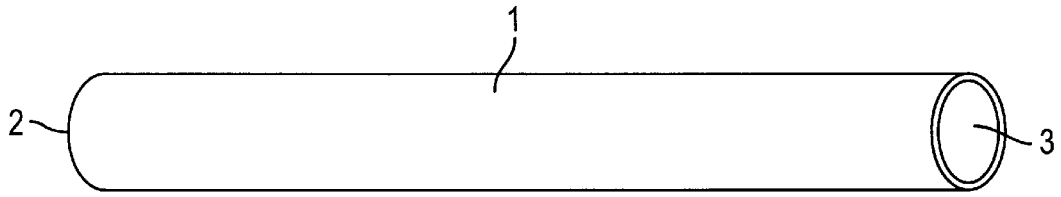
FIG. 1 to 4: various stages during the production of an exemplary embodiment of the exhaust gas manifold according to the invention.
Figure 2:
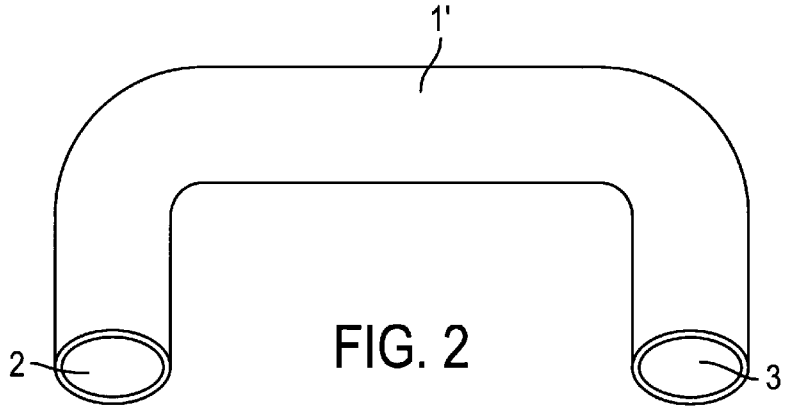
Figure 4:
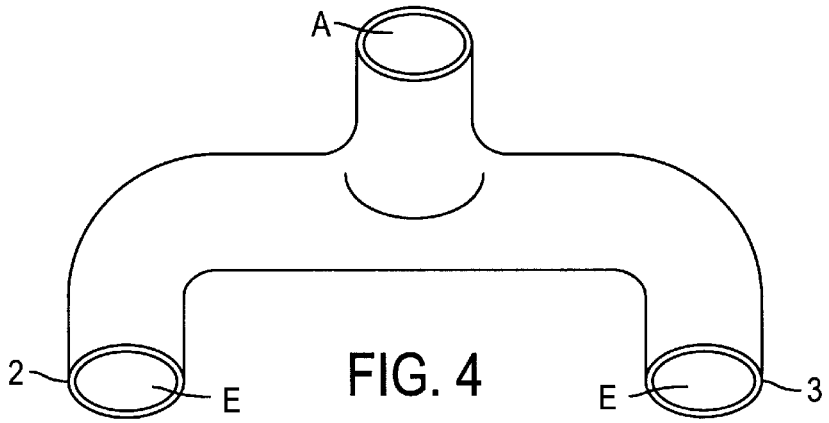

A tube piece 1 (FIG. 1) serves as the starting material for the production of the exhaust gas manifold (FIG. 4). The tube piece 1 is bent in a known bending device, in such a way that its two ends 2, 3, which are intended to form the inlets E of the finished tube junction (FIG. 4), take on practically their final position relative to one another. In the pre-bent piece 1' (FIG. 2), the progression of the tube piece between the two ends also corresponds essentially to the final progression.

Figure 3:
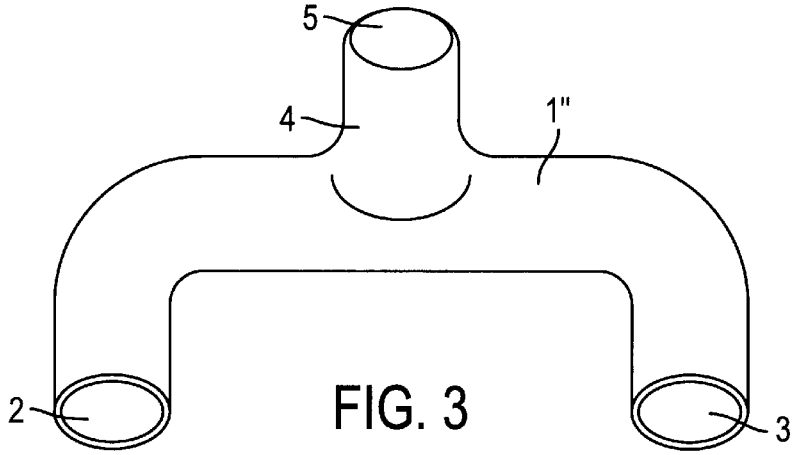

The pre-bent tube piece 1' is now placed into the forging die of a device in which the neck 4 (FIG. 3) is formed in the side wall of the pre-bent tube segment 1'. For this purpose, the forging die has an impression with a first recess, which is adapted to the shape of the pre-bent tube piece 1', and a second recess, into which the neck 4 is supposed to be formed. To form the neck, the pre-bent tube piece 1' is deformed by means of the method of interior high pressure deformation. For this purpose, a pressure medium is introduced into the tube piece, in known manner. As the pressure inside the tube piece increases, it deforms in the region of the second recess of the forging die, forming the neck 4.

After the tube piece 1" (FIG. 3) was removed from the forging die, after the process of interior high pressure deformation was completed, the "cap" 5 of the neck 4 is cut off, so that the outlet A (FIG. 4) of the finished tube junction is formed. Depending on further use, the inlets E and the outlet A of the tube junction can be fitted with flanges after the deformation process is finished.

Figure 5:
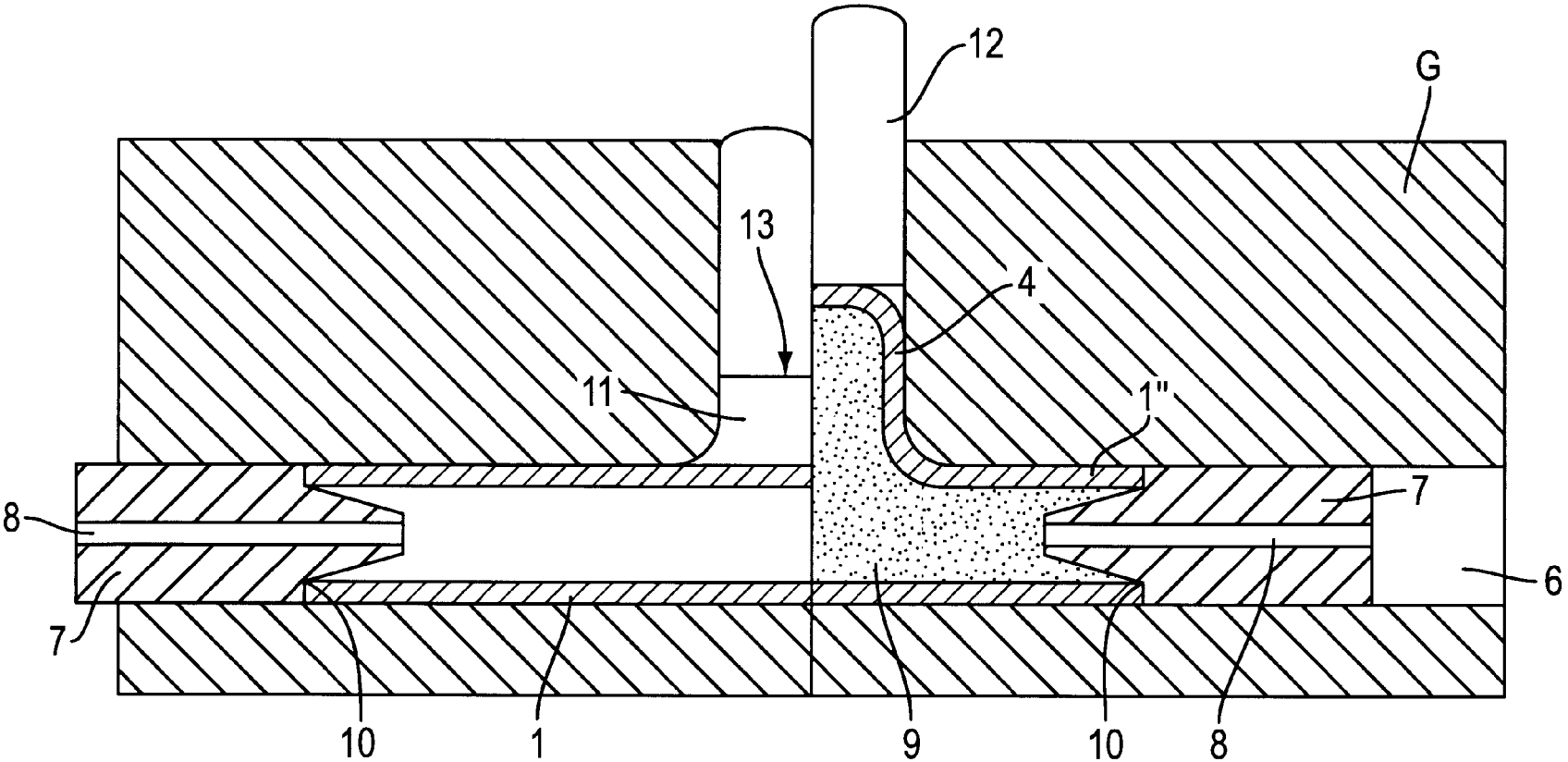
FIG. 5: a cross-section through a device suitable for production of the exhaust gas manifold according to the invention.

FIG. 5 illustrates the forging die G of a device in which interior high pressure deformation of a tube piece to form a neck takes place. In the left half of FIG. 5, the device is shown before the start of deformation of the tube piece, while it is shown at the end of the deformation process in the right half.

The forging die shown in FIG. 5 serves for deformation of a straight, not pre-bent tube piece 1. Accordingly, the first recess 6 is structured to be straight. Within it, two axial punches 7 are guided to move in its longitudinal direction. They each possess a bore 8, one of which serves to feed a pressure medium 9 into the tube piece 1, and the other of which serves for simultaneous ventilation. The axial punches 7 form a tight seal with the assigned ends of the tube piece 1, by means of a correspondingly structured sealing surface 10.

The second recess 11 opens into the first recess 6. The counter-punch 12 is guided to move in the former. A spring element—not shown—acts on the counter-punch 12, placing pressure on the counter-punch in the direction of the tube piece 1 placed in the first recess 6.

If the pressure medium 9 inside the tube piece 1 is placed under sufficiently high pressure, the outside wall of the tube piece 1 deforms into the second recess 11, so that the neck 4 is formed there. If deformation of the tube piece has progressed so far that the wall of the tube piece 1 rests against the face 13 of the counter-punch 12, the counter-punch 12 is shifted as the deformation continues, against the force of the spring acting on it. In other words, the neck 4, which constantly enlarges during the process of interior high pressure deformation, pushes the counter-punch 12 ahead of itself. Because of the counter-force acting on the counter-punch, the result achieved is that the deformation takes place slowly; this means that sufficient material can flow into the deformation region because of the follow-up produced by the axial punches 7. The follow-up of the axial punches 7 takes place by means of a separate follow-up device, not shown. A defined follow-up force is applied to both axial punches by means of this device, as a function of the pressure of the pressure medium 9.

What is claimed is:

1. A method for producing a tube junction having at least two inlets and an outlet, and at least one bend between said two inlets, comprising the steps:

a. providing a forging die with a first recess contoured to hold a bent tube piece, and with a second recess opening into said first recess, said second recess being terminated in a moveable counterpunch;

b. bending a tube piece having two inlets to bring said two inlets into positions relative to each other generally similar to relative positions of said inlets in said tube junction when finished;

c. placing said bent tube piece within said forging die;

d. pressurizing an inside of said bent tube piece to bulge a wall of said tube piece into said second recess to form a neck for said outlet;

e. controlling speed of motion away from said first recess of said counterpunch as said neck forms under pressure in said second recess.

2. A method as in claim 1, further comprising the step;

f. applying force proximate at least one said inlet to move material of said tube piece toward said second recess during steps d and e.

3. A method as in claim 2, further comprising the step of:

g. removing said pressurization and said forcing of said tube piece when, due to said moving of said at least one inlet, said two inlets are substantially in positions relative to each other as in said tube junction when finished.

4. A method as in claim 1, wherein said speed of motion is controlled by applying a force to said counterpunch that opposes said bulging of said wall.

5. A method as in claim 1, wherein said motion is controlled in relation to pressure in said tube piece.

6. A method as in claim 2, wherein said force proximate said at least one inlet moves said at least one inlet and is controlled in relation to at least one of pressure in said tube piece and distance of inlet movement.

* * * * *